US006206215B1

(12) United States Patent
Maa

(10) Patent No.: US 6,206,215 B1
(45) Date of Patent: Mar. 27, 2001

(54) RAIL CAR COUPLER

(76) Inventor: Shalong Maa, 816 McDeavitt Dr., #1077, Arlington, TX (US) 76011

( * ) Notice: Subject to any disclaimer, the term of this patent is extended or adjusted under 35 U.S.C. 154(b) by 0 days.

(21) Appl. No.: 09/259,188

(22) Filed: Feb. 26, 1999

Related U.S. Application Data

(60) Provisional application No. 60/076,288, filed on Feb. 27, 1998.

(51) Int. Cl.[7] ..... B61G 7/00

(52) U.S. Cl. ..... 213/75 R; 213/124; 213/131; 213/159; 213/211; 213/212

(58) Field of Search ..... 213/75 R, 104, 213/124, 133, 167, 211, 212, 219, 159, 161, 154, 131

(56) References Cited

U.S. PATENT DOCUMENTS 3,491,899 * 1/1970 Cope ..... 213/159
3,599,803 * 8/1971 Cope ..... 213/212
3,724,680 * 4/1973 Hines ..... 213/212
5,139,161 * 8/1992 Long ..... 213/124
5,775,524 * 7/1998 Dunham ..... 213/75 R

* cited by examiner

*Primary Examiner*—S. Joseph Morano
*Assistant Examiner*—Lars A. Olson

(57) ABSTRACT

Disclosed herein is improvement of the standard Type-E or Type-F coupler, which is compatible with the existing standard couplers, for providing automatic uncoupling features. The improved coupler includes a coupler head of the type having standard coupling knuckle, guard arm, and an standard interior knuckle-control structure within a lock-receiving chamber. Said interior knuckle-control structure includes the standard components such as a knuckle-lock attached to a lock-lift assembly, a knuckle thrower and other standard components. In order to provide the coupler with automatic uncoupling feature, an electric actuator, such as a motor or a solenoid, is installed within a chamber provided behind said guard arm. Said actuator controls the movement of the lock-lift assembly via a leverage system provided so that the coupler lock can be lifted to the lock-set position by said actuator. The actuator is connected to and controlled by the serialization and operation-control system of the train.

13 Claims, 4 Drawing Sheets

RAIL CAR COUPLER

This application claims the benefit of U.S. Provisional Patent Application No. 60/076,288, filed on Feb., 27, 1998.

FIELD OF THE INVENTION

The present invention relates in general to the fields of coupling devices and particularly to modification of the standard Type-E/Type-F coupler for railroad cars.

BACKGROUND OF THE INVENTION

It has been know in the railroad industry to connect together adjacent cars in a train by means of so-called "standard coupler", such as the Type-E and Type-F couplers utilized by American Association of Railroads (AAR). The coupling is achieved by means of interlocking knuckles pivotally carried on coupler heads by knuckle pins and controlled by means of knuckle locks within a lock-receiving chamber. The coupler heads are relatively massive castings connected to the undercarriages of railway cars. It is well known that the uncoupling of these standard couplers require manual operation which is very time-consuming.

So it will be appreciated if the couplers can be provided with fully automatic coupling-uncoupling features to dramatically improve the operation efficiency of the freight cars. It is understood that, with addition of electro-pneumatically operated breaking system and with the development of automatic train serialization technologies, it is possible to realize such automatic coupling-uncoupling control.

SUMMARY OF THE INVENTION

Accordingly, an object of the present invention is to provide an improved coupler for railroad cars in which its uncoupling operation can be controlled automatically by introducing, at the guard-arm side of the coupler head, an actuator connected to and controlled by the serialization and operation-control system of the train.

To achieve the foregoing and other objects of the present invention and to remedy drawbacks of the prior art described above, there is provided improved arrangement of mechanical couplers for railroad cars that is compatible with the existing standard couplers. According to one aspect of the present invention, an improved standard type-E or type-F coupler includes a coupler head of the type having standard coupling knuckle, guard arm, and an standard interior knuckle-control structure within a lock-receiving chamber. Said interior knuckle-control structure includes the standard components such as a knuckle-lock attached to a lock-lift assembly, a knuckle thrower and other standard components. In order to provide the coupler with automatic uncoupling feature, an electric actuator, such as a motor or a solenoid, is installed within a chamber provided behind said guard arm. Said actuator controls the movement of the lock-lift assembly via a leverage system provided so that the coupler lock can be lifted to the lock-set position by said actuator using electric power which can be controlled automatically by the operation-control system of the train.

The foregoing is intended to be merely a summary and not to limit the scope of the specification. The features of the present invention, which are believed to be novel, are set forth with particularity in the annexed claims. The invention, however, together with further objects and advantages thereof, may best be appreciated by reference to the following detailed description taken in conjunction with the drawings.

DETAILED DESCRIPTION OF THE INVENTION

Figure 1C:
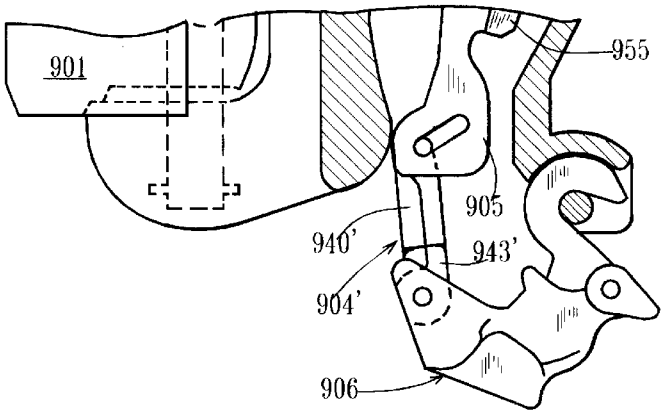
FIG. 1*c* is a sectional side view, taken along line v1c—v1c of FIG. 1*b*, showing the lower portion of the conventional coupler of FIG. 1*a*.

Referring to FIGS. 1–2, there is shown rail-car pneumatic-electric coupling systems embodying the concepts of the present invention. While the present invention is susceptible to embodiments in various forms, there is in the drawings and will hereinafter be described presently preferred embodiments, with the understanding that the present disclosure is to be considered as exemplifications of the invention, and does not limit the invention to the specific embodiments illustrated. In some instances, for purposes of explanation and not for limitation, specific numbers, or dimensions, or materials, etc., may be set forth in order to provide a thorough understanding of the present invention. In other instances, detailed descriptions of well-known mechanical elements or electronic circuitry are omitted so as to not obscure the depiction of the present invention with unnecessary details. In the case when alternate arrangements of a device or a component are described or displayed, like parts or components are assigned with the same reference numbers.

According to the present invention and to freight-car standard, the coupling devices described herein, which are to be installed at the two ends of a rail-car, and its oppositely facing coupling counterpart on an adjacent rail-car are substantially identical. Therefore, the left-side view of an coupler or coupling system is identical to the right-side view of its coupling counterpart, or vice versa, having a 180-degree rotation symmetry with respect to the vertical axis through the middle point between the two couplers. So for the purpose of simplicity, whenever displayed, the components of the coupling system and those of its coupling counterpart are assigned with the same parts numbers; while standard Type-E couplers are shown in the drawings and selected for the purpose of disclosing the present invention, it will be understood by those skilled in the art that the improvement and modification embodying the features of the present invention are equally useful in Type-E and Type-F couplers.

Figure 1A:
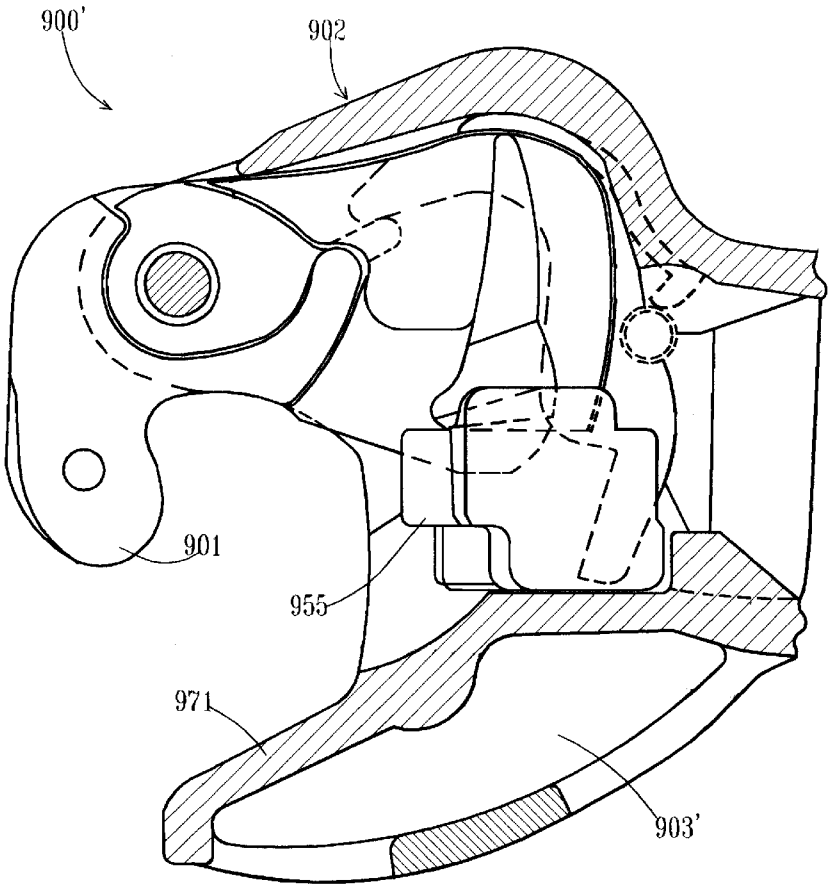
FIG. 1*a* is a horizontal sectional plane view of a prior art standard coupler.
Figures 1B, 2D:
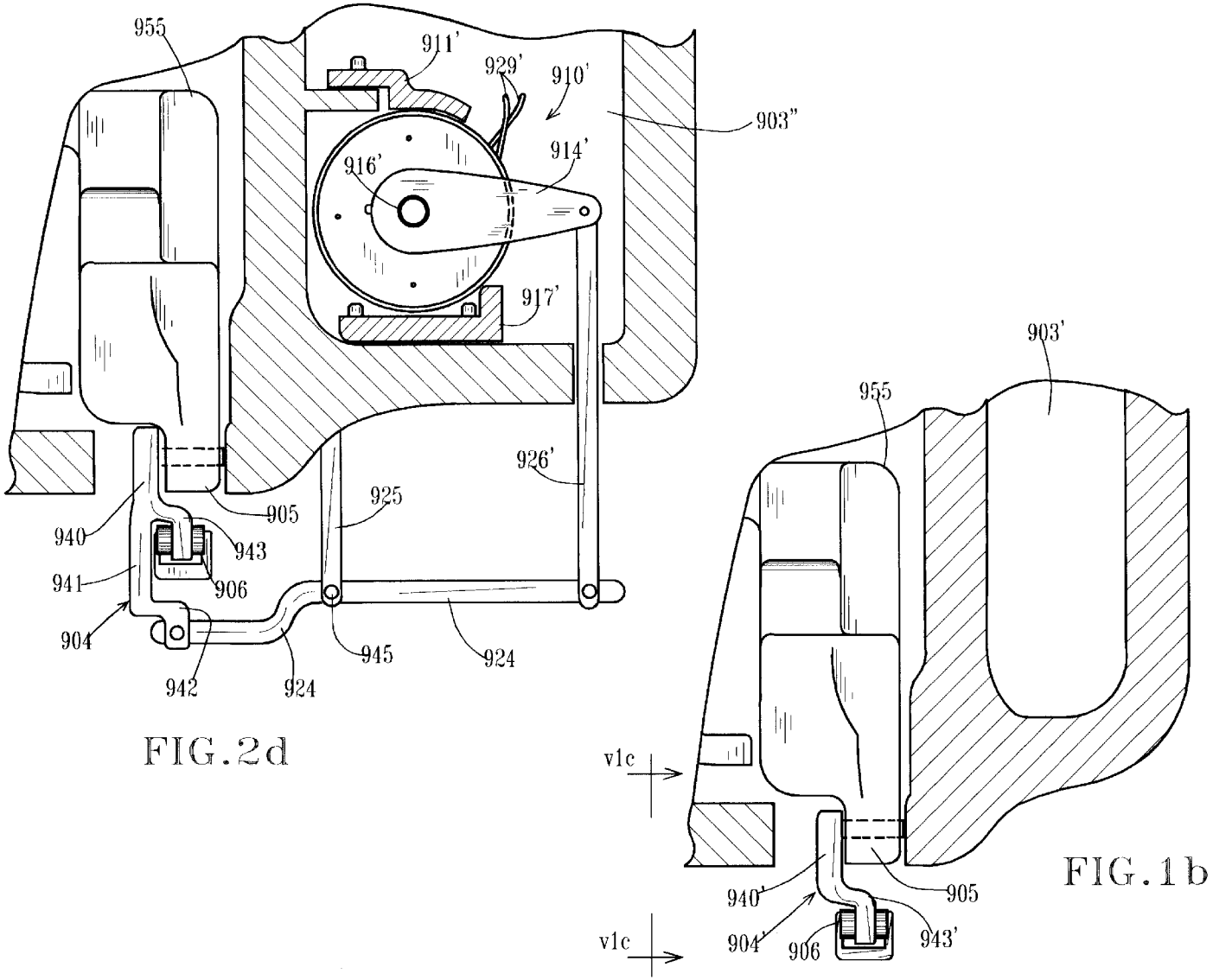
FIG. 1*b* is a sectional front view showing the lower right portion of the conventional coupler of FIG. 1*a*.
FIG. 2*d* is a sectional view of the lower right portion of an alternate arrangement of the modified coupler of FIG. 2*a*.

According to one aspect of the present invention, the commonly used prior art conventional mechanical coupler 900', which has manually-controlled uncoupling mechanism, can be improved to include an automatic uncoupling actuator. The structure of prior art coupler head design 900', which may be a standard type-E or type-F coupler, is shown in FIGS. 1*a*–1*c*. As shown in the figures and as it is well known to those in the art, the coupler head 900' includes, at its front, a knuckle 901 which is pivotally attached to the casting structure of the head 900'. The knuckle 901 has a knuckle tail which is received within a lock-receiving chamber at one side 902 of the coupler head 900', with the arrangement thereto well known to those in the art and standardized by AAR. Also received within said lock-receiving chamber includes a knuckle lock 955 and knuckle thrower, etc. The knuckle thrower is supported by the coupler head for movement between thrown and locked positions; the knuckle thrower is engageable by and movable with said knuckle toward their locked positions, with the arrangement thereto well known to those in the art and standardized by AAR.

The other side of the coupler head 900' is the guard arm 971 and an empty chamber 903' behind the guard arm that has no internal structure. The dimension and geometric structure of the aforesaid lock-receiving chamber, the guard arm 971, the knuckle 901, the lock 955, and other portions and components of the standard coupler head 900' such as the knuckle-thrower, etc., are standardized by AAR (Association of American Railroad).

It is also well known, and as shown in the figures, that the lock 955 has a lower leg portion that is connected to a lock-lift assembly 906 via a toggle 904', with the mechanical arrangement thereof also standardized. The lock-lift assembly 906 is actuated by the usual manually-controlled uncoupling rod (not shown) to raise the lock 955 from a lowest locking position, at which the lock 955 restricts the swinging of the knuckle tail, to the so-called lock-set position, at which the lock 955 permits the swinging of the knuckle 901, or to the fully unlock position. Usually the toggle 904' is not vertically straight. As shown in FIG. 1*c,* the toggle 904' has an upper portion 940', which is connected to the lock leg 905 in a well known way, and a lower portion 943', which is pivotally connected to the lock-lift assembly 906; and there is a bending segment at the middle of the toggle 904'.

Referring now to FIGS. 2*a*–2*d,* there is shown a modified head portion 900 of an conventional coupler according to the present invention. The purpose of such an improvement is to install an electrical actuator 910, such as an electric motor or a two-phase solenoid or the like, onto the coupler head for automatically controlling the positions of the knuckle lock 955 of the coupler 900 via a leverage system. According to the present invention, such an electric actuator 910 is received within an modified chamber 903 (hereinafter, actuator chamber) behind the guard arm 911 of the coupler head 900, as shown in the figure. It is understood that such a modification will not affect the standard arrangement of other portion of the coupler head 900, since, as it is well known, there is not interior structure for the chamber 903' behind the guard arm 971 for a standard coupler. Other portions and components of the coupler head 900, such as the knuckle 901, the lock 955, the lock-receiving chamber, the guard arm 971, the knuckle-thrower, etc., shall be the same as the prior art standard Type-E or Type-F coupler.

Figure 2C:
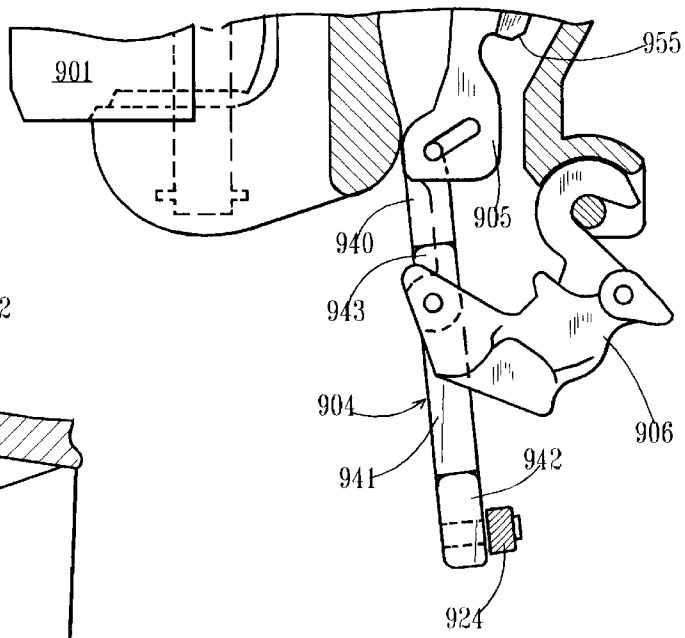
FIG. 2*c* is a sectional view, taken along line v2c—v2c of FIG. 2*b*, showing the lower portion of the modified coupler of FIG. 2*a*.
Figure 2A:
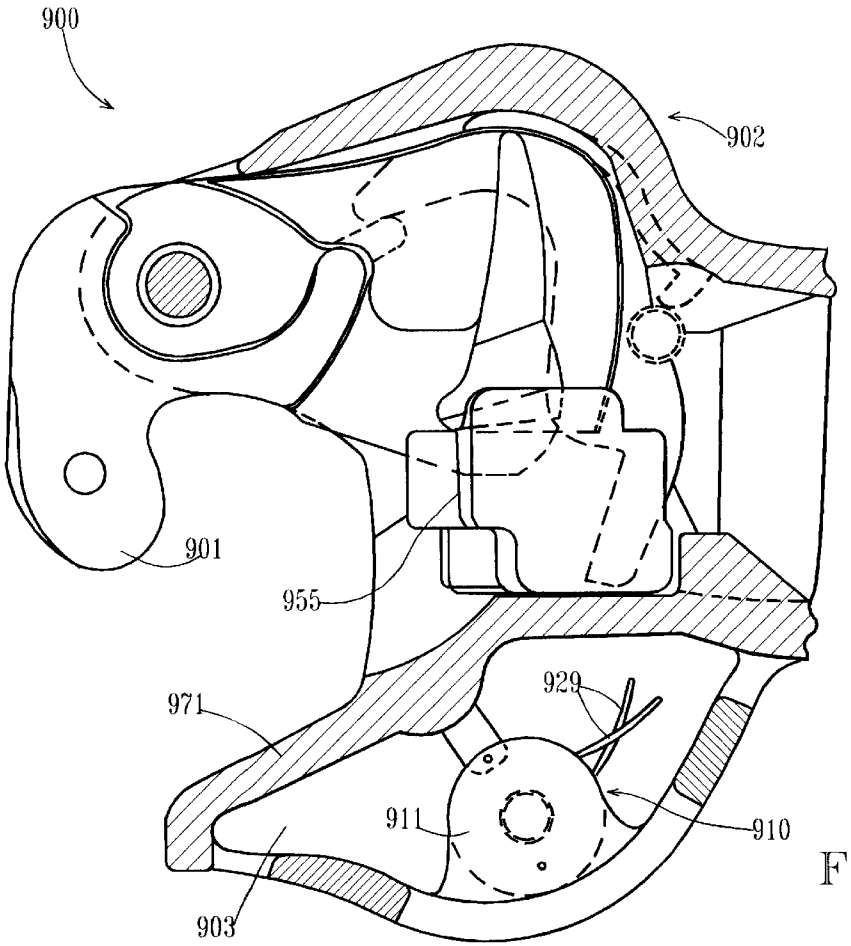
FIG. 2*a* is a horizontal sectional plane view of the modified coupler according to the present invention.
Figure 2B:
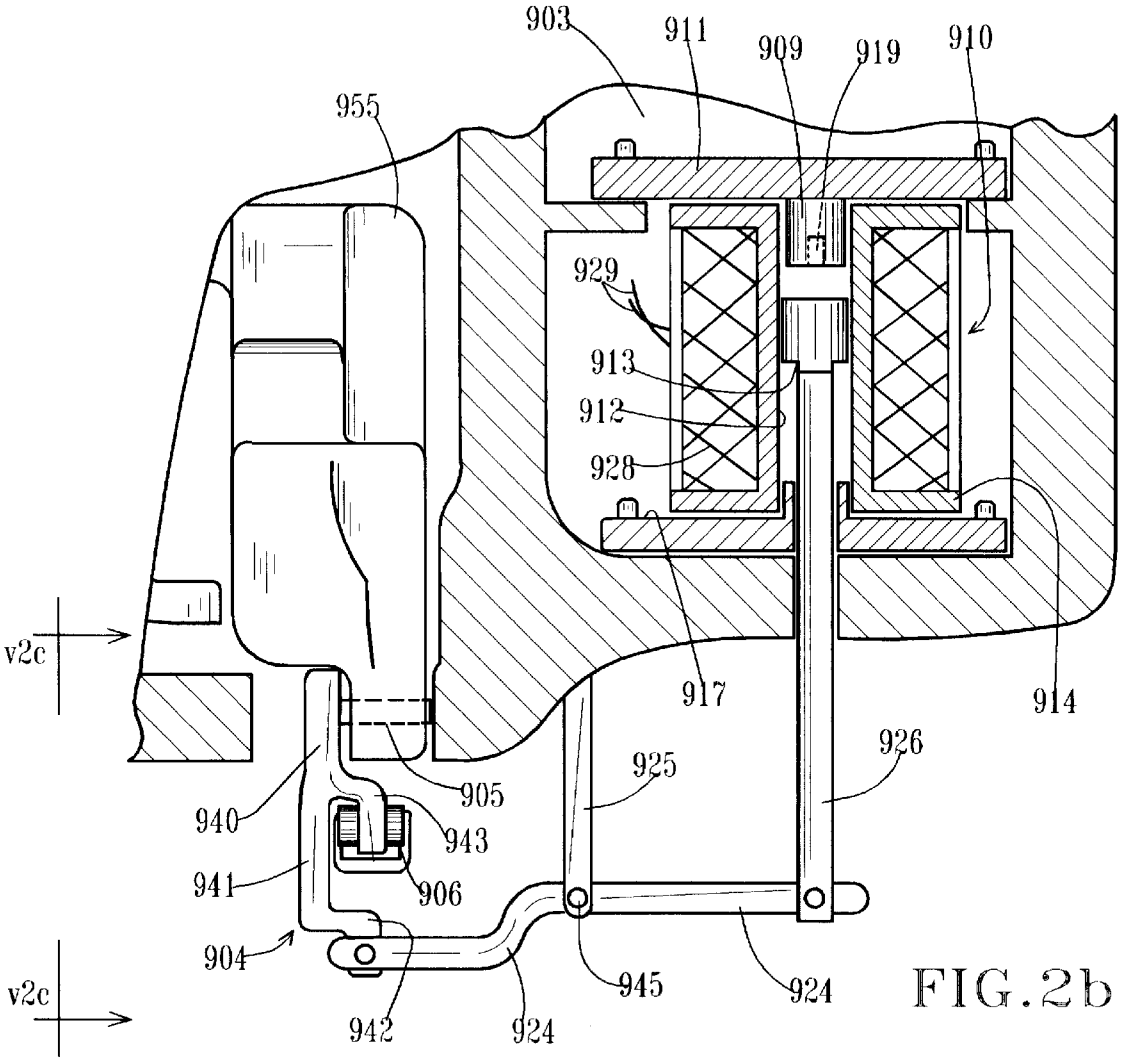
FIG. 2*b* is a sectional front view showing the modified lower right portion of the coupler of FIG. 2*a*.

As described, the electric actuator 910 can be a two-phase solenoid. Referring now to FIG. 2*b* in conjunction with FIGS. 2*a* and FIG. 2*c,* there is shown that an electric solenoid 910 is installed within the actuator chamber 903 behind the guard arm 971 of the coupler head 900. The solenoid 910 includes at least one electric coil 928 around a cylindrical solenoid frame 914 which has a through-bore 912 at its center. The electric coil 928 has leads or connectors 929 that connect the solenoid coil 928 to an appropriate power supply or solenoid driver. The solenoid 910 is properly secured to the side walls and the bottom of the actuator chamber 903 by a top cover 911 and a bottom cover 917. The top cover 911 has, at its bottom, an annular trunnion 909 that fits into the top of the bore 912 of the solenoid frame 914. Alternatively, any other feasible means for attaching the solenoid 910 onto the interior of the actuator chamber 903 can also be used.

The central bore 912 of the solenoid frame 914 receives a movable magnetic plunger 913 which is attached at its lower end to a vertical shaft 926. The actuator shaft 926 extends downwardly, passing through the lower portion of the central bore 912 of the solenoid 910 and across the bottom of the chamber 903 and the bottom cover 917, to the exterior of the chamber 903. The lower end of the actuator shaft 926 is connected to the lock leg 905 via a lever 924 and via a modified lock-lift toggle 904, as will be described next.

As described above, the structures and arrangements of the knuckle 901 and all the components within the lock-receiving chamber of the improved coupler head 900 are the same as the standard type-E or type-F coupler head of FIGS. 1. However, the lock leg 955 is connected to the standard lock-lift assembly 906 via a modified toggle 904, as shown in the figures. The modified toggle 904 shall be constructed in such a way that its upper segment 940 is similar to, and is connected to the lock leg 905 the same way as, the upper portion 940' of the prior art standard lock-lift toggle 904' of FIG. 1. The lower portion of the modified toggle 904 is pivotally connected to both the conventional lock-lift assembly 906 and the lever 924 that connects to the lower end of the actuator shaft 926. As shown in FIGS. 2*b*–2*c,* the upper portion 940 of the modified toggle 904 has a downward extension 941, which, together with the upper portion 940, form a vertical arm. Such vertical arm of the toggle 904 has, at its lower end, a lower connection branch 942 which is pivotally connected to one end of the lever 924. The toggle 904 also has a middle connection branch 943 pivotally connected to the conventional lock-lift assembly 906. It is preferred that the vertical distance between the two branches 942 and 943 of the modified toggle 904, and the lateral distance between the elements 943 and 941 of the toggle 904, are large enough for allowing the above-described manual lock-lift operation. As it is well known, during such manual lock-lift operation, the body portion of the lock-lift assembly 906 will swing to the underneath the element 943.

As shown in the figures, one end of the lever 924 is pivotally connected to the lower end of the actuator shaft 926, and the other end of the lever 924 is pivotally connected to the lower end of the modified lock-lift toggle 904. The lever 924 is supported by a vertical rod 925, which is secured to the bottom of the coupler-head casting 900 at an appropriate position. The lever-support rod 925 is pivotally connected to the middle portion of the lever by a pivot 945.

The actuation mechanism of the solenoid 910 is provided by the magnetic field generated from the solenoid coil 928 when its leads 929 are connected to an appropriate electric DC power source. Such a magnetic field will present magnetic forces on the magnetic plunger 913, which will in turn push the shaft 926 downwardly. Such a downward force on the shaft 926 will be transferred, via the lever 924 and the modified lock-lift toggle 904, to the lock leg 905. In this way, the lock 955 can be lifted to its lock-set position or to its fully-unlock position. The direction of the magnetic force on the magnetic plunger 913 can be changed by changing the direction of the DC current in the solenoid coil 928.

It is appreciated that the lock-lift arrangement described herein can allow both manual as well as automatic/electric lock-lift operations, which is necessary to solve the interface problem when the freight car installed the coupler 900, is to join a train consist that does not have electric-control system installed. Alternatively, if such an interface problem does not exist in the future, the toggle 904 can be modified accordingly.

In order for the operator at the front locomotive to fully control the automatic coupling-uncoupling process between two cars of a train consist, it is necessary for the operator to monitor the lock position of each car's couplers. This can be accomplished by installing a proximity sensor 919 with appropriate detecting range at the lower end of the annular trunnion 909 of the aforesaid solenoid cover 911 for monitoring the position of the solenoid plunger 913, as shown in the figure. Alternatively, the proximity sensor 919 can be replaced by a magnetic sensor or any other feasible sensor for detecting the position of the solenoid plunger 913 with appropriate detecting range. The sensor 919 is connected to the electronic system of the freight car 4 in an appropriate way, and will send different signals to the electronic systems of the train when the position of the plunger 926 changes. In this way, the electronic systems of the train can determine the position of the coupler lock 955 of each car according to the signals from the sensor 919.

It is understood that the solenoid actuator 910 of FIG. 2*c* can be replaced by any type of electric motor, such as a stepper motor, for controlling the position of the rod 926.

For example, as shown in FIG. 2*d,* a stepper motor 910' is affixed to the lower portion of the actuator chamber 903" of the coupler head 900 by a top compression plate 911' and by a bottom support 917'. The members 911' and 917' are affixed to the side wall and bottom of the chamber 903" respectively. The torque from the rotation shaft 916' of the motor 910' is transferred to a vertical rod 926' via a leverage arm 914', which is affixed to the motor shaft 916' at one end and is pivotally connected to the rod 926' at the other end. The rod 926' extends downwardly to the exterior of the chamber 903" via a through hole at the bottom of the chamber 903". The leverage arrangements between the lower end of the rod 926' and the lock leg 905, including the lever 924, the lever-support rod 925, and the modified lock-lift toggle 904, and the connections thereof, are the same as the leverage system shown in FIG. 2*c* motor 910' is connected to an appropriate power supply via the connectors 929'. It is now appreciated that the rotation of the motor shaft 916' will control the position of the coupler lock 955.

Naturally, the embodiment of the coupling devices used in the invention is not limited to the above-described examples. While certain novel features of this invention have been shown and described and are set out in the appended claims, it will be understood that various substitutions and changes in the forms and details of the devices described throughout this invention and in their operation can be made by those skilled in the art without departing from the spirit of the invention.

What is claimed is:

1. In a railroad freight-car coupler having a coupler head having a guard-arm side and a knuckle side including a chamber formed within said coupler head at said knuckle side, a knuckle swingable about a vertical axis supported by said coupler head with a tail portion thereof extending from said knuckle, said knuckle being movable between thrown and locked positions, a knuckle thrower supported by said head for movement between thrown and locked positions, said knuckle thrower being engageable by and movable with said knuckle toward their locked positions, and a coupler lock including a lower leg portion depending from an upper lock portion situated within said chamber, said lock being movable within said chamber between thrown, lockset, and locked positions, said lock being movable, due to gravity, toward its locked position wherein said lock is in the path of movement of said tail portion of said knuckle;

the improvement therein comprising a lock-lift assembly including an elongated toggle means for moving said lock toward its lockset and thrown positions and movable with said lock toward its locked position, and actuation means installed on said coupler head and operating at lower portion of said toggle means for moving said coupler lock toward its lockset and thrown positions.

2. The invention according to claim 1 wherein said actuation means is controlled by electric power.

3. The invention according to claim 1 wherein said improvement includes a second chamber formed at said guard-arm side of said coupler head, said actuation means being within said second chamber.

4. The invention according to claim 3 wherein said actuation means is engaged with said coupler lock via a leverage means for moving said lock toward its lockset and thrown positions.

5. The invention according to claim 4 wherein said leverage means is engaged, at its first end, with said actuation means from underneath, and at its second end, with the lower portion of said elongated toggle means.

6. The invention according to claim 1 wherein said actuation means includes an electric motor.

7. The invention according to claim 1 wherein said actuation means includes an electric solenoid means including a movable shaft.

8. The invention according to claim 7 wherein said solenoid means includes means for detecting the positions of said movable shaft.

9. The invention according to claim 7 wherein the lower portion of said movable shaft is engaged with the lower portion of said elongated toggle means via a leverage means.

10. a railroad coupler having a coupler head having a guard-arm side and a knuckle side including a chamber formed within said coupler head at the knuckle side, a knuckle swingable about a vertical axis supported by said coupler head with a tail portion thereof extending from said knuckle, said knuckle being movable between thrown and locked positions, a knuckle thrower supported by said head for movement between thrown and locked positions, said knuckle thrower being engageable by and movable with said knuckle toward their locked positions, a coupler lock including a lower leg portion depending from an upper lock portion situated within said chamber, said lock being movable within said chamber between thrown, lockset, and locked positions, said lock being movable, due to gravity, toward its locked position wherein said lock is in the path of movement of said tail portion of said knuckle, a lock-lift assembly including an elongated toggle for moving said lock toward its lockset and thrown positions and movable with said lock toward its locked position, and actuation means for moving said coupler lock toward its lockset and thrown positions, said actuation means being controlled by electric power, said coupler head including a second chamber formed at said guard-arm side, said actuation means being within said second chamber.

11. The invention according to claim 10 wherein said actuation means is engaged with said coupler lock via a leverage means for moving said lock toward its lockset and thrown positions, said leverage means being movable with said coupler lock toward its locked position.

12. The invention according to claim 11 wherein said leverage means is engaged, at its first end, with said actuation means from underneath, and at its second end, to the lower portion of said elongated toggle.

13. a railroad freight-car coupler having a coupler head having a guard-arm side and a knuckle side including a first chamber formed within said coupler head at said knuckle side, a knuckle swingable about a vertical axis supported by said coupler head with a tail portion thereof extending from said knuckle, said knuckle being movable between thrown and locked positions, a knuckle thrower supported by said head for movement between thrown and locked positions, said knuckle thrower being engageable by and movable with said knuckle toward their locked positions, a coupler lock within said chamber, said lock being movable within said chamber between thrown, lockset, and locked positions, and lock-lift means including toggle means for moving said lock toward its lockset and thrown positions and movable with said lock toward its locked position, said lock-lift means further including electro-mechanical actuation means for moving said coupler lock toward its lockset and thrown positions.

* * * * *